United States Patent [19]

Anahara et al.

[11] Patent Number: 4,575,999

[45] **Date of Patent: * Mar. 18, 1986**

[54] PNEUMATIC NOZZLE UTILIZED IN THE PROCESS OF PRODUCING A FASCIATED YARN

[75] Inventors: Meiji Anahara, Kariya; Hiroshi Omori, Aichi, both of Japan

[73] Assignee: Kabushiki Kaisha Toyoda Jidoshokki Seisakusho, Aichi, Japan

[ * ] Notice: The portion of the term of this patent subsequent to Mar. 20, 2001 has been disclaimed.

[21] Appl. No.: 513,412

[22] Filed: Jul. 14, 1983

[30] Foreign Application Priority Data

Jul. 21, 1982 [JP] Japan ..... 57-125853

[51] Int. Cl.[4] ..... D01H 5/28; D02G 1/04

[52] U.S. Cl. ..... 57/333; 28/271; 57/328

[58] Field of Search ..... 57/333, 350, 403, 328; 28/271–276

[56] References Cited

U.S. PATENT DOCUMENTS

| | | | |
|---|---|---|---|
| 3,340,684 | 9/1967 | Schichman | 57/333 X |
| 4,141,121 | 2/1979 | Trifunovic | 28/271 |
| 4,217,323 | 8/1980 | Foster et al. | 28/271 X |
| 4,242,859 | 1/1981 | Lundgren | 57/333 X |
| 4,434,611 | 3/1984 | Hasegawa et al. | 57/333 X |
| 4,437,302 | 3/1984 | Anahara et al. | 57/333 |
| 4,468,845 | 9/1984 | Harris | 28/273 X |

*Primary Examiner*—John Petrakes

*Attorney, Agent, or Firm*—Burgess, Ryan & Wayne

[57] ABSTRACT

In a pneumatic nozzle utilized in the process of producing a fasciated yarn, provided with a transporting passage of a fiber bundle in which an inlet portion, a smaller channel, and a large channel having an outlet opening are successively arranged along the longitudinal axis of the transporting passage, and a plurality of air supply apertures for ejecting compressed air toward a restricted region of the transporting passage, a plurality of small chambers formed around the large channel is symmetry with respect to the large channel's longitudinal axis and connecting apertures for connecting the large channel to the outside of the nozzle so that air introduced into the large channel through the inlet opening and the air-supply apertures can be partly discharged, while the remaining part of the above-mentioned air is discharged from the outlet of the large chamber. In this nozzle, a supplemental ring can be used to adjust the air condition in the large chamber by mounting on a discharge end portion of the nozzle.

6 Claims, 8 Drawing Figures

PNEUMATIC NOZZLE UTILIZED IN THE PROCESS OF PRODUCING A FASCIATED YARN

BACKGROUND OF THE INVENTION

1. Field of the Invention

The present invention relates to an improvement of a pneumatic nozzle for false-twisting a bundle of fibers in the spinning process for producing a fasciated yarn.

2. Description of the Prior Art

In fasciated yarn spinning, a bundle of fibers (hereinafter referred to as a fiber bundle) delivered from a pair of front rollers of a draft means is introduced into an air nozzle and therein is false twisted by a vortex. During untwisting of the false twisted fiber bundle, part of the fibers in the fiber bundle entangle around a core portion thereof to form a fasciated yarn. Generally speaking, in order to obtain a good quality yarn, the fiber bundle has to be fed in the shape of a ribbon having a sufficient number of free-end fibers prior to being twisted. A free-end fiber is a fiber wherein one end thereof is embedded in the body of the bundle and the other end is free. By the application of a vortex, part of the free-end fibers are converted to wrap fibers which entangle around the core portion of the resultant yarn.

In order to generate a sufficient number of free-end fibers, twisting of the fiber bundle in the nozzle inlet must be suppressed as much as possible to maintain the ribbon shape thereof. Therefore, a typical conventional air nozzle has a small channel in its fiber passage between the inlet portion and a large channel in which a vortex is generated. The false twist of the fiber bundle can be prevented to a certain extent from ascending to the inlet portion by the small channel. For example, Japanese Unexamined Patent Publication (Kokai) No. 52-63462 discloses such a type of pneumatic nozzle for producing a fasciated yarn. In such a type of nozzle, the twist-suppressing effect increases as the cross-sectional size of the small channel becomes smaller. However, a reduction of the size of the small channel causes insufficient suction of the air nozzle, which results in various problems, such as the generation of many flies, fiber wrapping on the roller surface, and the generation of less free-end fibers. On the other hand, if the cross sectional area of the small channel is enlarged to increase the quantity of air sucked from the inlet portion of the nozzle so as to prevent the above-mentioned trouble, the twist-suppressing effect by the small channel is reduced. Accordingly, effective fasciation of fibers in the resultant yarn cannot be expected. Moreover, there is a certain possibility to create a ballooning of the fiber bundle in the nozzle, which obstructs the twisting and untwisting phenomenon of fiber bundle in the nozzle. To eliminate these drawbacks of the prior art nozzle disclosed, it was considered to increase the volume of air sucked into the inlet portion of the nozzle while keeping the cross-sectional area of the small channel restricted in size, by which the twist suppressing effect can be maintained in a desirable condition. The air introduced into the large channel is discharged therefrom rapidly by shortering it so as to maintain the air pressure in the large channel as low as possible. However, in such a condition, the twisting and untwisting operation of the fiber bundle in the nozzle cannot be effectively carried out and the above-mentioned ballooning of the fiber bundle in the nozzle becomes more active so that the running condition of the fiber bundle in the nozzle becomes unstable. Consequently, frequent yarn breakages cannot be prevented.

Examined Patent Publication (Kokoku) No. 56-31370, discloses a false twisting nozzle having a short axial length thereof which is comparatively shorter than the conventional nozzle. This nozzle is connected to a tube for untwisting the bundle of fibers twisted by the action of the nozzle. The inside diameter of this tube is made smaller than the outlet diameter of the nozzle. A plurality of fine grooves is formed in the inside wall of the tube so as to enhance the discharge of air therefrom. Such fine grooves in the inside wall, however, damage fibers in the outer layer of the bundle of fibers.

SUMMARY OF THE INVENTION

The purpose of the present invention is to eliminate the above-mentioned problems in known pneumatic nozzles utilized in the spinning process for producing fasciated yarn.

To attain the purpose of the present invention, the pneumatic nozzle according to the present invention is designed to have a construction, size of the small channel, and size of the large channel related for the optimum functioning of each. Also, the nozzle is provided with a particular construction for effectively and rapidly discharging air from the large channel.

The pneumatic nozzle according to the present invention is provided with a passage for carrying a fiber bundle. This passage is composed of an inlet portion, a large channel, and a small channel which connects the inlet portion with the large channel. In the large channel of the pneumatic nozzle, at least one aperture for ejecting air introduced into the large channel is opened in a direction fit for tangentially applying air jet stream to the inside cylindrical wall of the large channel so that a vortex flowing to the opened end of the large channel is created. Therefore the twisting and untwisting phenomenon of the fiber bundle can be created as mentioned hereinbefore regarding the prior art of Japanese Unexamined Patent Publication No. 52-63462. However, to eliminate the drawbacks of the pneumatic nozzles such as disclosed in the above-mentioned prior arts, a plurality of apertures which connect the large channel to the outside of the nozzle are provided at positions downstream of the aperture for ejecting an air jet into the large channel of the nozzle, whereby a part of the volume of the above-mentioned vortex can be discharged from the apertures beside the opened end of the large channel so that the air pressure in the large channel can be effectively lowered. Accordingly, an effective twisting and untwisting phenomenon applied to the fiber bundle in the nozzle to create a fasciated yarn can be created.

DESCRIPTION OF THE PREFERRED EMBODIMENTS

Figure 1:
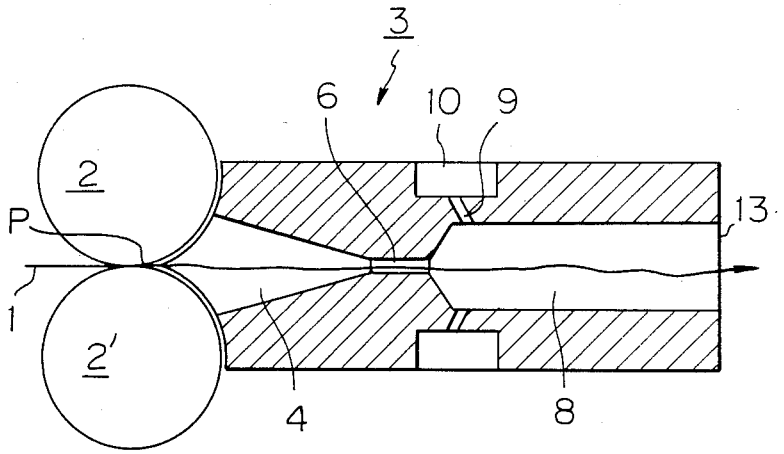
FIG. 1 is a cross-sectional side view of a conventional pneumatic nozzle for producing a fasciated yarn, taken along the longitudinal direction thereof.

The principle of the method for producing a fasciated yarn is hereinafter explained with reference to a conventional pneumatic nozzle shown in FIG. 1. As shown in FIG. 1, the draft element for drafting a material fiber bundle in provided with pair of rollers 2, 2'. A pneumatic nozzle 3 is disposed at an adjacent downstream position of the delivery rollers 2, 2'. The pneumatic nozzle 3 is provided with a passage to carry the fiber bundle 1. This passage is formed by an inlet portion 4, a large channel 8, and a small channel 6 which connects the inlet portion 4 to the large channel 6. At least one aperture 9 for ejecting air into the large channel 8 is formed in the nozzle 3 in such that the axial direction of each aperture is tangentially directed the cylindrical inside wall of the large channel 8. An end of each aperture 9 is connected to a corresponding chamber 10 formed at an outside position of the large channel 8. The chamber 10 is connected to a supply source of compressed air (not shown). The other end of each aperture 9 is opened to the inside cylindrical wall of the large channel 8 such that, in FIG. 1, the longitudinal axis of each aperture 9 is forwardly inclined to the longitudinal axis of the large channel 8, so that it enables the running of the fiber bundle to be accelerated.

The longitudinal axes of the small channel 6 and the large channel 8 are aligned. The relative position of the nip point P formed by the front rollers 2, 2' to the small channel 6 and the large channel 8 is such that either (a) the nip point P is positioned on the longitudinal axes of the small channel 6 and the large channel 8 or (b) the nip point P is slightly displaced to the nozzle 3 so that the nip point P is positioned below the longitudinal axes. In the latter case, for example, the nip point P may be positioned on an imaginary plane which tangentially contacts the cylindrical lower wall of the small channel 6 and which is parallel to the longitudinal axis of the roller 2 in FIG. 1. To introduce all fibers of the fiber bundle delivered from the front rollers 2 and 2' into the small channel 6 effectively, the inlet portion 4 of the nozzle 3 is designed such that the cross-sectional area thereof is gradually increased toward the nip point P. This enables smooth guiding of all fibers of the fiber bundle delivered from the rollers 2, 2', even if some fibers are displaced along the roller surface of one or both of rollers 2, 2'.

Figure 2:
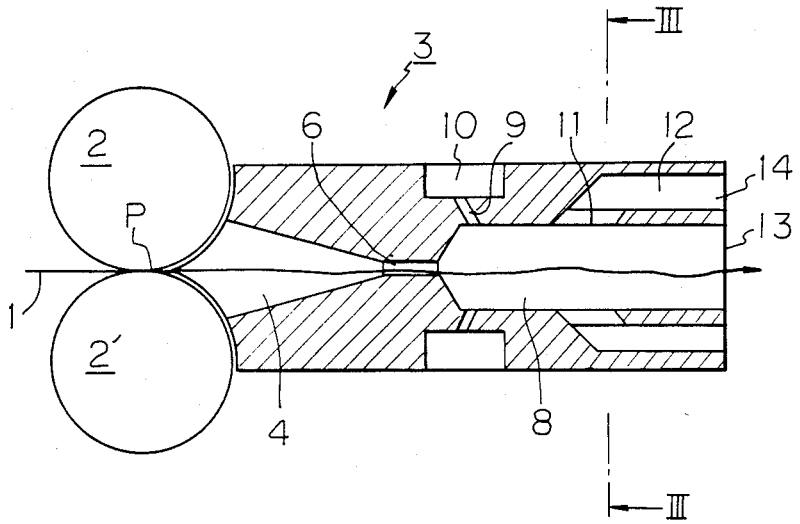
FIG. 2 is a cross-sectional side view of a pneumatic nozzle according to the present invention, taken along the longitudinal direction thereof.
Figure 3:
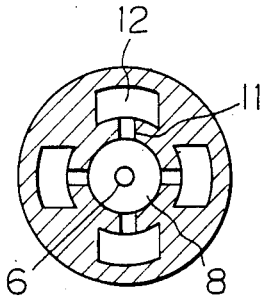
FIG. 3 is a cross-sectional view of the pneumatic nozzle of FIG. 2, taken along a line III—III.

Next, a first embodiment of the present invention is hereinafter explained in detail with reference to FIGS. 2 and 3. In FIGS. 2 and 3, parts identical to those in FIG. 1 are indicated by the same reference numerals in the first embodiment, the nozzle 3 is provided with four small chambers 12 around the large channel 8 downstream from the chamber 10. The small chambers 12 are positioned so that they are symmetrical with respect to the longitudinal axis of the large channel 8. The cross section of each small chamber 12 taken perpendicular to the longitudinal axis of the large channel 8 is substantially rectangular as shown in FIG. 3. Each small chamber 12 is connected to the large channel 8 by a connecting aperture 11.

The function of the pneumatic nozzle 3 shown in FIGS. 2 and 3 is hereinafter explained in detail. The fiber bundle 1 delivered from the front draft rollers 2, 2' in a ribbon shaped condition is sucked into the inlet portion 4 of the nozzle 3 with a suction air stream toward the small channel 6. All fibers of the fiber bundle 1 are smoothly introduced into the small channel 6, because of the funnel shaped inside wall of the inlet portion 4. The inlet portion, as mentioned earlier, increases in cross sectional area perpendicular to the longitudinal axis of the inlet portion 4 upstream. This increase is gradual so as to minimize the resistance of the inside wall to the moving fibers. The air stream introduced from the aperture 9 into the large channel 8 creates a vortex which flows spirally about the longitudinal axis of the large channel 8 so that the twisting and untwisting phenomenon, is created. According to the experiments regarding the above-mentioned known nozzle disclosed in FIG. 1, it was confirmed that, if the nip point P is located in the above-mentioned condition (b), the twist-suppressing effect by the small channel 6 can be effectively created. Therefore, in the first embodiment according to the present invention, such condition (b) is applied.

According to the experiments, it was confirmed that if the air pressure in the large channel 8 increased, since smooth discharge of air supplied into the large channel 8 therefrom is disturbed, the volume of suction air into the inlet portion 4 would decrease. Under these conditions, it would be quite difficult to prevent wrapping of fibers about one or both of the front rollers 2, 2', or increasing of flying fibers. Also, an increase in the air pressure in the large channel would result in non-uniform fasciating of the outside fibers about the core portion of the fiber bundle 1, and, therefore, damage the yarn appearance and decrease the tensile strength of the fasciated yarn thus produced.

Our experiments confirmed that, in the normal spinning condition, the quantity of air introduced into the large channel 8 through the apertures 9 is in a range between 20 and 50 Nl/min, while the quantity of air introduced into the inlet portion 4 is in a range between 5 and 20 Nl/min. The above-mentioned quantity of air, of course, varies according to the shape and size of the nozzle 3. However, it is desirable that the air introduced into the large channel 8 through the aperture(s) 9 be rapidly discharged therefrom without excessively increasing the air pressure therein so as to create the effective twisting and untwisting phenomenon applied to a fiber bundle 1 in the nozzle 3, even if the activity of the vortex becomes weak in accordance with the position toward the outlet opening of the large channel 8.

To satisfy the above-mentioned requirement, in the nozzle of the present invention, four apertures 11 connected to the respective small chambers 12 are provided so as to rapidly discharge a part of the air introduced into the chamber 8 via the small chamber 6 and the apertures 9. As shown in FIG. 3, the four apertures 11 are radially formed in the nozzle 3 at the respective positions downstream to a restricted region in the large channel 8 where the air jet form the air supply aperture 9 is directed. These positions are located in an identical condition with respect to the longitudinal axis of the large channel 8. Therefore a part of the above-mentioned combined air can be rapidly discharged outside from the chamber 8 via the apertures 11, while the remaining combined air is discharged from an opened terminal 13 of the chamber 8. Accordingly, even if a very active stream of compressed air is introduced into the chamber 8, all possibility of the above-mentioned troubles can be prevented. In summary, the additional formation of apertures 11 in the nozzle 3 enables rapid discharge of large volume of air from the large chamber 8, and also increasing the volume of suction air through the inlet portion 4. Consequently, fasciation of fiber bundle can be stably and effectively created. In this first embodiment shown in FIGS. 2 and 3, in the case of a large channel 8 having an inside cylindrical diameter between 3 and 5 mm, the length of the aperture 11 is preferably between 5 and 30 mm, more preferably between 10 and 20 mm, and the width thereof is preferably between 0.3 and 1.0 mm, more preferably between 0.4 and 0.8 mm and the aperture 11 is provided with a rectangular cross section.

Figure 5:
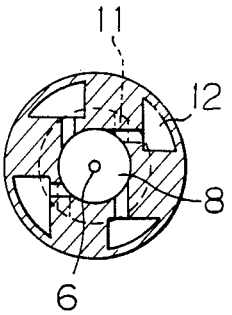
FIG. 5 is a cross-sectional view of the pneumatic nozzle of FIG. 4, taken along a line V—V.
Figure 4:
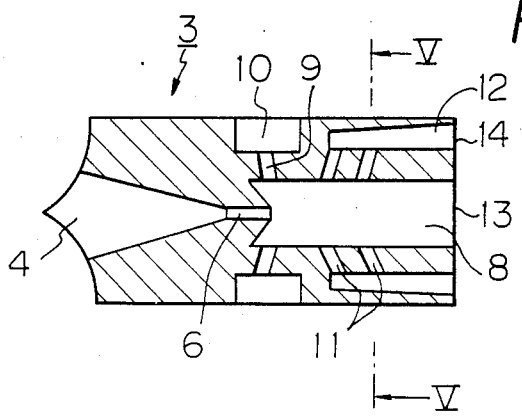
FIG. 4 is a cross-sectional side view of a second embodiment of the pneumatic nozzle according to the present invention, taken along the longitudinal direction thereof.

In a second embodiment of the nozzle 3 shown in FIG. 4, a plurality of group of apertures 11, which connect the large channel 8 to the respective small chambers 12, are formed along the lengthwise direction of the channel 8. In each group, the apertures 11 are radially formed about the longitudinal axis of the channel 8 in symmetry, as shown in FIG. 5. In this embodiment, each aperture 11 is tangentially formed to the inside cylindrical wall of the channel 8 so as to effectively discharge air therethrough. It is also preferable that the distance between two adjacent groups of apertures 11 be smaller, the closer the group of apertures 11 to the aperture 9.

Figure 6:
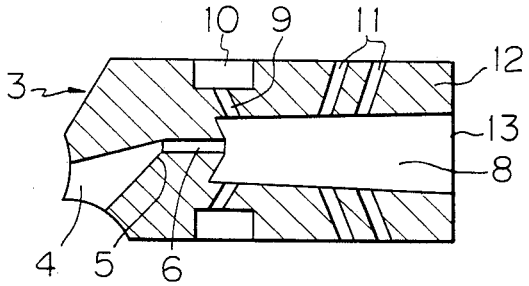
FIG. 6 is a cross-sectional side view of a third embodiment of the pneumatic nozzle according to the present invention, taken along the longitudinal direction thereof.

In a third embodiment of the nozzle 3 shown in FIG. 6, the longitudinal axis of the inlet opening 4 and that of the small channel 6 are crossed. Because of such construction of the nozzle 3, the migration of twist created by the spiral vortex in the restricted region facing the aperture(s) 9 in the large chamber 8, toward the fiber bundle 1 in the inlet opening 4, can be effectively suppressed. This enables a very effective spinning operation to create fasciated yarn. In this embodiment, the apertures 11 are directly opened to the atmosphere for effective discharge of a part of the air from the large channel 8.

Figure 7:
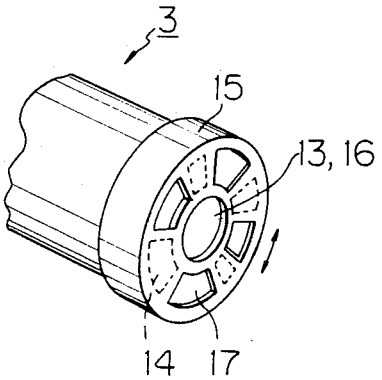
FIGS. 7 and 8 are perspective views of end portions of the pneumatic nozzles according to the present invention, wherein a supplemental ring is mounted at the downstream end of the pneumatic nozzle respectively.
Figure 8:
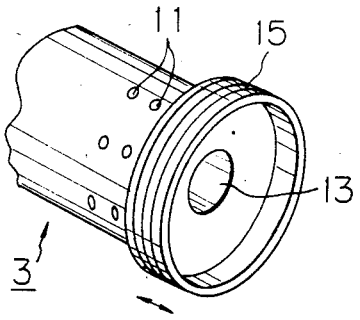

In the above-mentioned embodiments with air-discharging apertures 11, it was observed that, at the time of commencing the spinning operation, when the compressed air is ejected into the chamber 8 through the aperture(s) 9, fasciated yarn which is not completely formed may be introduced into the aperture 11 together with the discharging air stream. To prevent such trouble, as shown in FIGS. 7 and 8, a supplemental ring 15 can be mounted on the discharge end of the nozzle 3, so as to adjust the size of opening of the channel 8 for discharging air therethrough. In the embodiment shown in FIG. 7, the supplemental ring 15 is mounted on the pneumatic nozzle 3. In this supplemental ring 15, openings 16 and 17 are formed at positions facing the opening 13 and the opening 14 of the small chambers 12. Therefore, when the spinning operation is commenced, the ring 15 is turned about the axis of the nozzle 3 so as to displace the angular position of the opening 17 and decrease or shut the free space for discharging air from the openings 14. After the spinning condition becomes stable, the axial positions of the aperture 16 are returned to the positions facing the corresponding aperture 14, whereby the discharge of air through the apertures 11 from the large channel 8 can be effectively performed.

In the embodiment shown in FIG. 8, the supplemental ring 15 is mounted on the nozzle 3 disclosed in FIG. 6. In this embodiment, the apertures 11 can be closed by displacing the supplemental ring 15 along the lengthwise direction of the nozzle 3. As mentioned above, the supplemental ring 15 can be additionally applied for the nozzle 3 shown in FIGS. 2, 4, and 6 so as to control the air condition in the large channel 8 at the time of commencing the spinning operation.

We claim:

1. In a pneumatic nozzle utilized in the process of producing a fasciated yarn, provided with a passage for transporting a bundle of fibers in which an inlet portion, a small channel, and a large channel having an outlet opening communicating to the outside at a downstream end thereof are successively arranged from the upstream end thereof to the downstream end thereof and at least one air-supply aperture for tangentially ejecting compressed air toward a restricted region of said passage in said large channel, an improvement comprising a supplemental connecting means formed in said nozzle for connecting said large channel with the outside of said nozzle, said connecting means being formed downstream of said restricted region in said large channel where said air stream from said air-supply aperture is directed, whereby a part of the air in said large channel is capable of discharging through said connecting means while the remaining volume of air in said large channel is discharged through said outlet opening of said large channel.

2. An improved pneumatic nozzle according to claim 1, wherein said supplemental connecting means comprises a plurality of small chambers formed around said large channel in symmetry with respect to the longitudinal axis of said large channel, and connecting apertures, each of which connects said large channel with a corresponding one of said small chambers, each small chamber being provided with an outlet opening opened toward outside of said nozzle.

3. An improved pneumatic nozzle according to claim 1, wherein said supplemental connecting means comprises a plurality of groups of apertures connecting said large channel to the outside of said nozzle, each group of said apertures is comprised a plurality of apertures substantially symmetrically formed in said nozzle with respect to the longitudinal axis of said large channel.

4. An improved pneumatic nozzle according to claim 3, wherein a distance to two adjacent groups of said apertures along the longitudinal axis of said large channel is preferably selected in such a condition that said distance is smaller, the closer the group of said apertures to said restricted region in said large channel.

5. An improved pneumatic nozzle according to claim 3, further comprising a supplemental ring mounted on a downstream end of said nozzle in displaceable condition along the longitudinal axis of said nozzle, whereby said groups of apertures can be selectively closed by displacing said supplemental ring along the longitudinal direction of said nozzle.

6. An improved pneumatic nozzle according to claim 1, further comprising a supplemental ring mounted on a downstream end of said nozzle, said supplemental ring provided with a function for adjusting the size of said outlet opening of said large channel.

* * * * *